United States Patent [19]

Shine

[11] 3,931,689

[45] Jan. 13, 1976

[54] ILLUMINATED SIGN HOUSING CONSTRUCTION

[75] Inventor: William P. Shine, Monroe, Conn.

[73] Assignee: Dual-Lite Company, Newtown, Conn.

[22] Filed: June 12, 1974

[21] Appl. No.: 478,521

[52] U.S. Cl. ..... 40/132 R

[51] Int. Cl.[2] ..... G09F 13/06

[58] Field of Search..... 40/132 R, 132 D, 152, 156, 40/130 R

[56] References Cited

UNITED STATES PATENTS

| | | | |
|---|---|---|---|
| 1,469,946 | 10/1923 | Morrison | 40/132 D |
| 1,724,243 | 8/1929 | Willey | 40/132 R |
| 1,790,583 | 1/1931 | Hildebrant | 40/132 D X |
| 3,136,083 | 6/1964 | Guth | 40/132 R |
| 3,235,989 | 2/1966 | Brooks | 40/130 R |
| 3,324,290 | 6/1967 | Lasker | 40/130 R X |
| 3,402,494 | 9/1968 | Gray | 40/130 R |
| 3,478,455 | 11/1969 | Fremont | 40/132 R |

*Primary Examiner*—Wm. H. Grieb

*Attorney, Agent, or Firm*—Mattern, Ware and Davis

[57] ABSTRACT

By providing a frame structure and two panels adapted for removable, interlocking mounting on the frame structure, a sign housing is obtained which is rapidly assemblable without the use of screws, clips, or other such fastening means. In the preferred embodiment, the sign housing is employed as an illuminated emergency exit sign, and can be flush-mounted with only one side viewable or mounted to ceilings or walls with both sides viewable. Also, an emergency power supply can be secured directly to the sign housing to provide a complete independent package.

23 Claims, 17 Drawing Figures

CENTERED FIG. 16
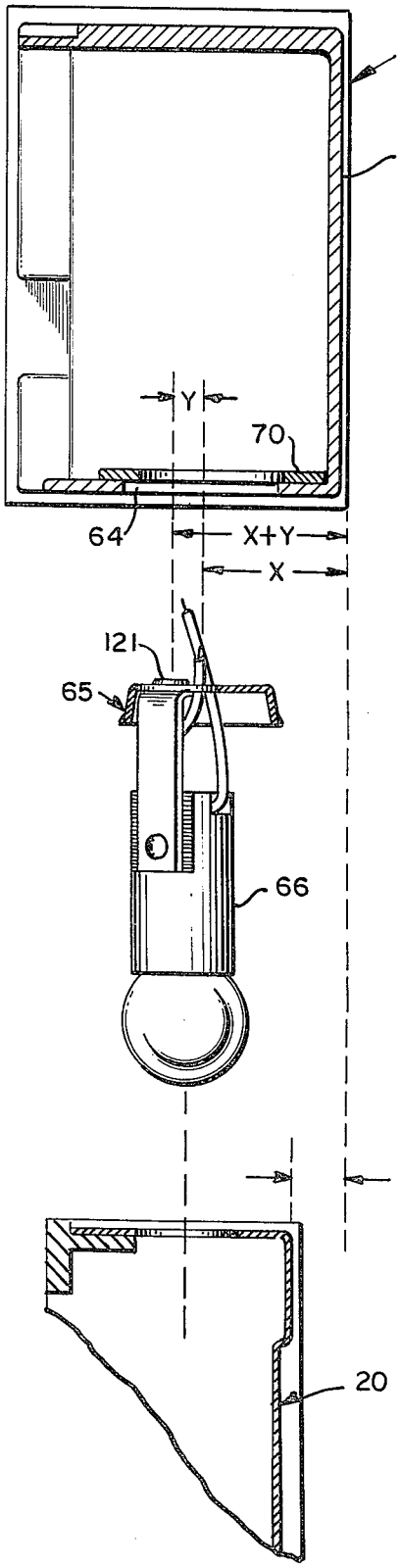
OFFSET FOR FLUSH TO WALL MOUNT FIG. 17
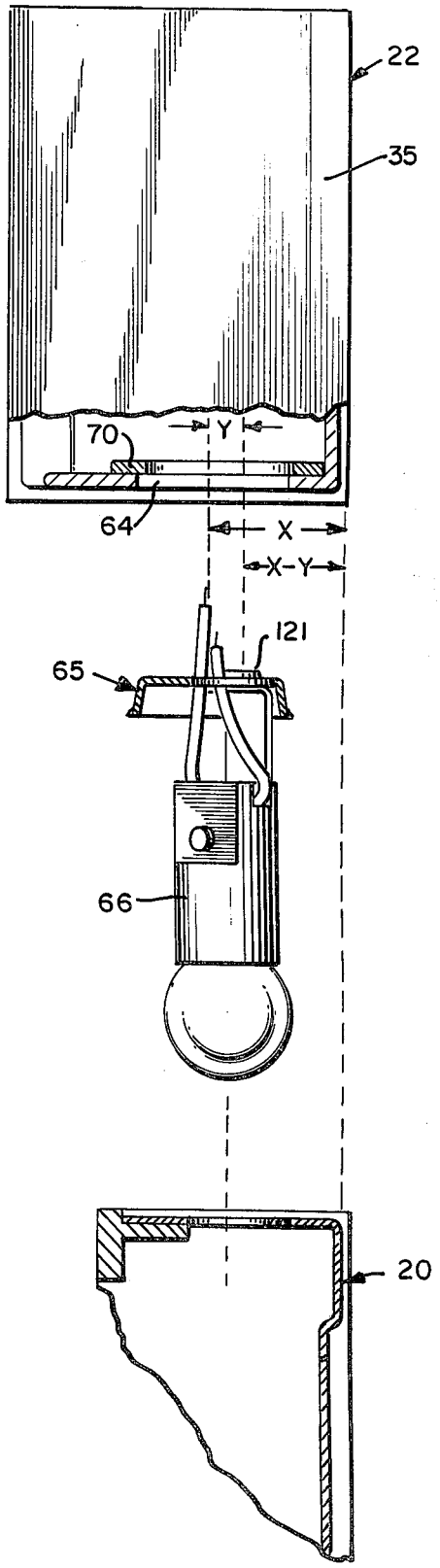

ILLUMINATED SIGN HOUSING CONSTRUCTION

SUMMARY OF THE INVENTION

This invention relates to illuminated housings and more particularly to exit-type sign housings.

Most prior art exit sign housings are constructed with a plurality of independent parts, which are held together by screws, clips, and other such independent fastening means. Since these exit sign housings are generally mounted to ceilings or to walls at or near the ceiling, difficulties arise in assembling these exit sign housings with the various screws required to hold the housing together. Another problem arises when bulbs must be replaced, since the housing must be substantially disassembled in order to change the bulbs, or repeatedly jam, making bulb replacement very difficult.

Furthermore, most prior art exit sign housings are separately manufactured for the particular location at which the housing is to be employed. Consequently, the exit sign housing must be individually purchased, depending upon whether it is to be flush-mounted to the ceiling, flush-mounted to a wall, or suspended from a ceiling or wall away from an adjacent wall.

Also, prior art exit sign housings, although provided with auxiliary light bulbs incorporated within the housing do not easily convert to an auxiliary power supply. As a result, a central auxiliary power supply must be provided, and the housing must be connected to this central auxiliary lighting supply source, as well as the main power lighting supply source.

OBJECTS OF THE INVENTION

Therefore, it is an object of this invention to provide an exit sign housing which can be rapidly assembled without the use of screws, clips, and similar independent fastening means.

Another object of this invention is to provide an exit sign housing of the above character having one basic unit which can be mounted in any desired location or position.

Another object of this invention is to provide an exit sign housing of the above character which can be readily connected to its own independent auxiliary emergency power supply for lighting the emergency lights.

A further object of this invention is to provide an exit sign housing of the above character in which light bulbs can be quickly and easily replaced.

Another object of this invention is to provide an exit sign housing of the above character which is constructed from a minimum of interlocking parts.

Other objects will in part be obvious and will in part appear hereinafter.

The exit sign assembly of this invention incorporates three basic parts, a frame structure, a rear panel, and a front panel. The frame structure incorporates the externally visible depending sides of the exit sign housing, while also incorporating top and bottom mounting portions. The rear panel is secured between the top and bottom mounting portions of the frame structure by means of interconnecting lock arrangements.

The front panel is slidingly engaged on the frame structure and in its normally locked position engages the bottom portion of the frame structure, as well as latch means near the top of the frame structure. In its open position, the top of the front panel is secured near the base of the frame structure. By employing this unique construction, the front panel can be quickly and easily slid from its normally locked position to its open position, allowing complete access to light bulb sockets.

By employing this readily assemblable sign construction, the exit sign housing of this invention can be easily and quickly assembled and secured in position with a minimum of effort. Furthermore, all of the parts interfit and lock together, thereby eliminating the need for independent fastening means. The exit sign housing of this invention is also constructed so as to cooperate with a bracket assembly which can be mounted at the top or the side of the housing. In this way, the exit sign housing can be easily secured to ceilings or walls where there are no other supporting structures.

Furthermore, the exit sign housing of this invention cooperates, if desired, with an independent auxiliary emergency power supply which is mountable on the top of the exit sign housing. In this manner, the exit sign housing of this invention can be completely independent of any central emergency power source.

As an additional feature, one embodiment for the rear panel of the exit sign housing of this invention is constructed for flush mounting of the housing directly to a wall. This optional construction feature allows for the customization of the housing to a particular use, while still employing the same basic unit.

In the preferred embodiment, the exit sign housing of this invention incorporates a reflector plate which mounts on the light bulb sockets and assures reflection of the light to optimize the brilliance of the front and rear panels. Also, in the preferred embodiment, the bottom portion of the frame structure incorporates similar reflective surfaces in order to add greater assurance of proper light reflection.

The invention accordingly comprises a product possessing the features, properties, in the relation of components, which will be exemplified in the product hereinafter described, and the scope of the invention will be indicated in the claims.

THE DRAWINGS

For a fuller understanding of the nature and objects of the invention, reference should be had to the following detailed description, taken in connection with the accompanying drawings, in which.

Figure 14:
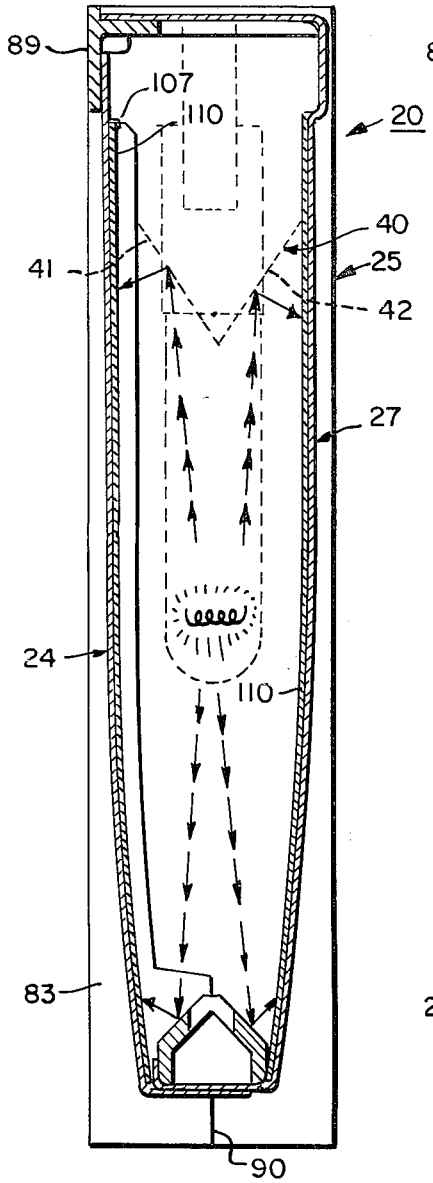
Figure 15:
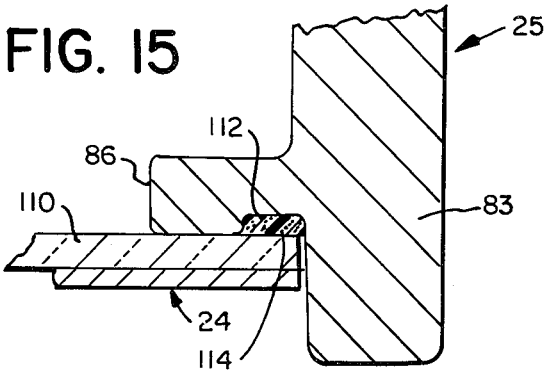

FIG. 14 is a cross-sectional side elevation view of one embodiment of the exit sign housing of this invention completely assembled; and FIG. 15 is a cross-sectional top view of one corner of the exit sign housing of this invention, taken along line 15 of FIG. 14; and FIGS. 16 and 17 are exploded side views, partially in cross section, showing the various orientations in which the exit sign housing can be mounted to the auxiliary power supply.

For convenience and clarity, the same reference numbers refer to the same elements throughout the several views of the drawings.

DETAILED DESCRIPTION

Figure 1:
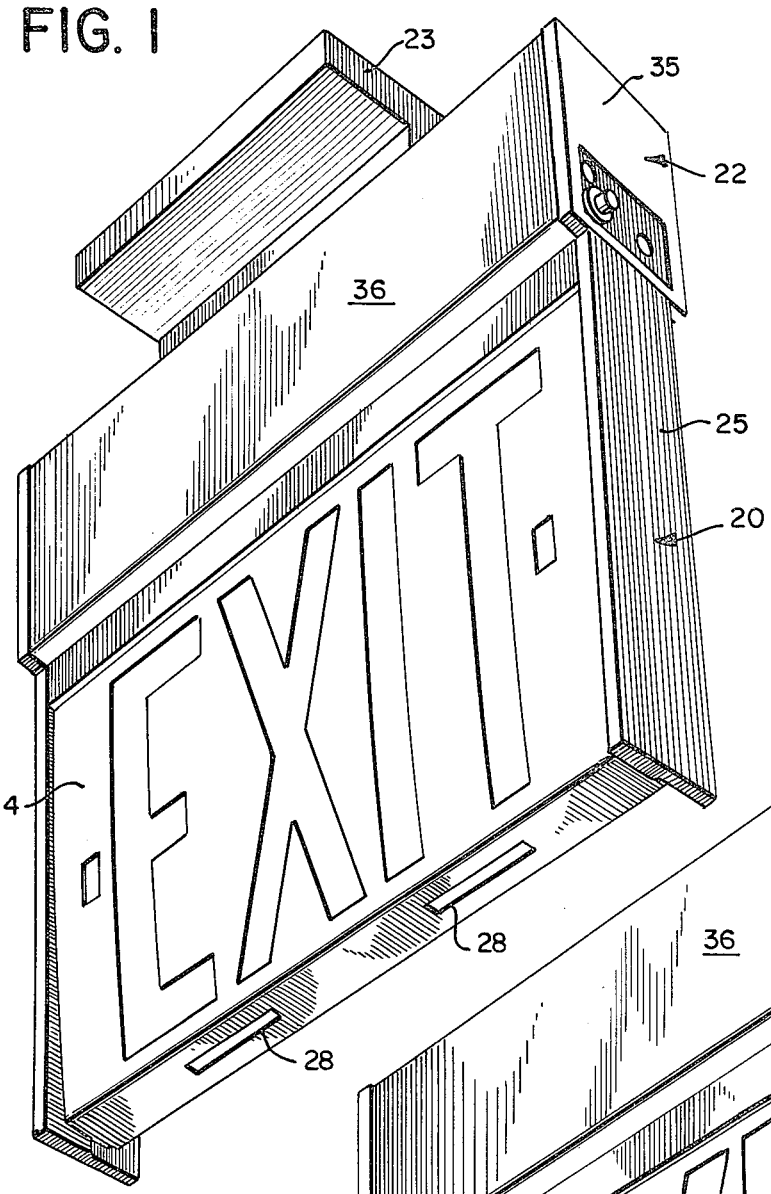
FIG. 1 is a perspective view of one embodiment of the exit sign housing of this invention with an emergency power package and bracket mounted thereon.

One embodiment of the exit sign construction of this invention is shown in FIG. 1. In this embodiment, exit sign housing 20 is shown with auxiliary power supply 22 mounted to the top of exit sign housing 20, and bracket 23 mounted to the top of auxiliary power supply 22. With this arrangement, the exit sign construction of this invention can be mounted directly to ceilings in any desired location.

Figure 2:
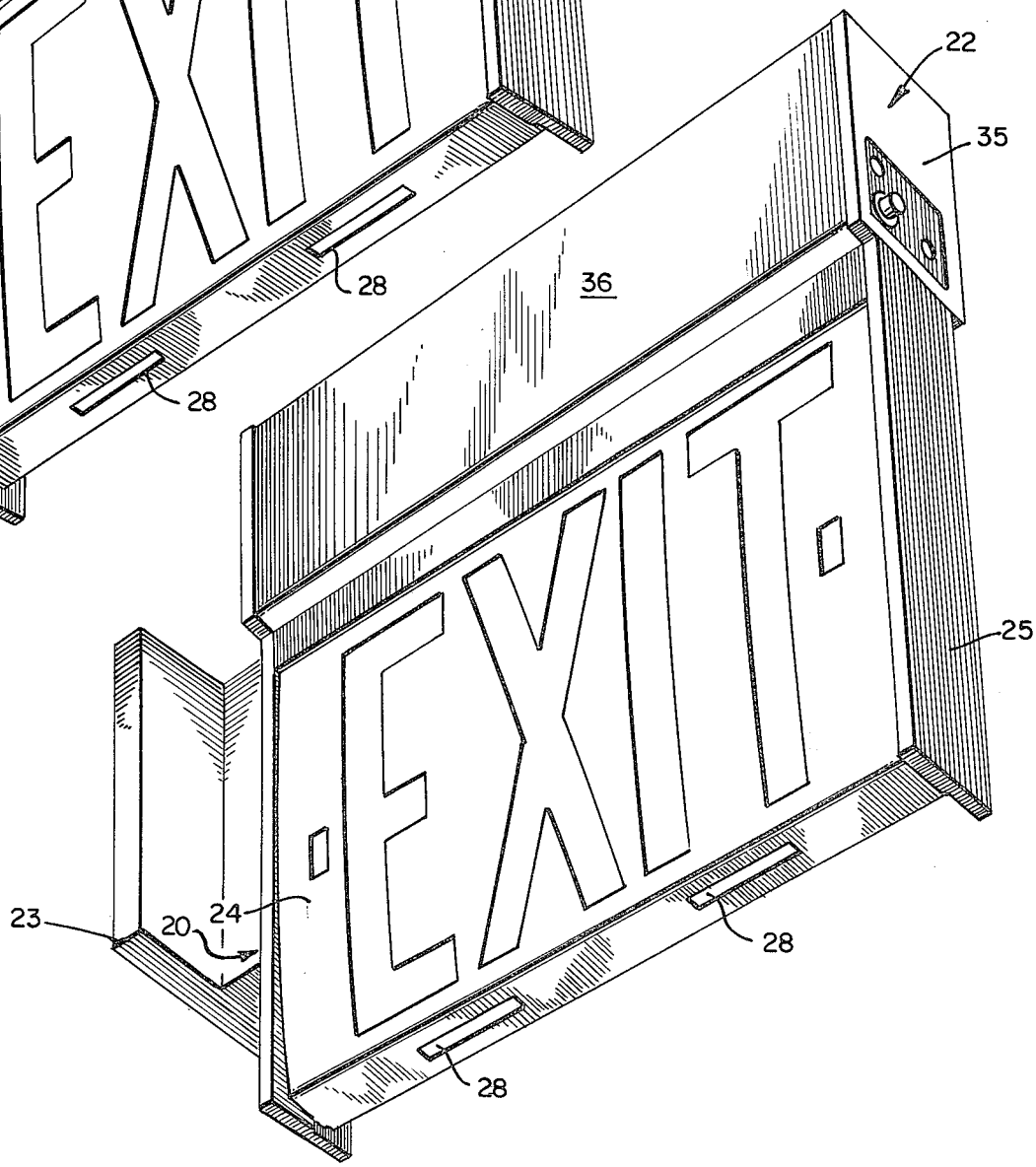
FIG. 2 is a perspective view of another mounting arrangement for the exit sign housing of this invention, with the auxiliary power supply and bracket mounted on the housing.

Another embodiment of the exit sign construction of this invention is shown in FIG. 2. In this embodiment, exit sign housing 20 is shown with auxiliary power supply 22 mounted to the top of housing 20, while bracket 23 is mounted to the side of housing 20. With this arrangement, the exit sign construction of this invention can be mounted directly to walls in any desired location.

In order to provide a modularized exit sign construction which incorporates as many identical interfitting parts as is possible, exit sign housing 20 comprises a front panel 24, which incorporates a large stencil having the letters "EXIT", and frame members or structures 25. Auxiliary power supply 22 comprises a container 35 and an interfitting, locking cover 36.

Figure 3:
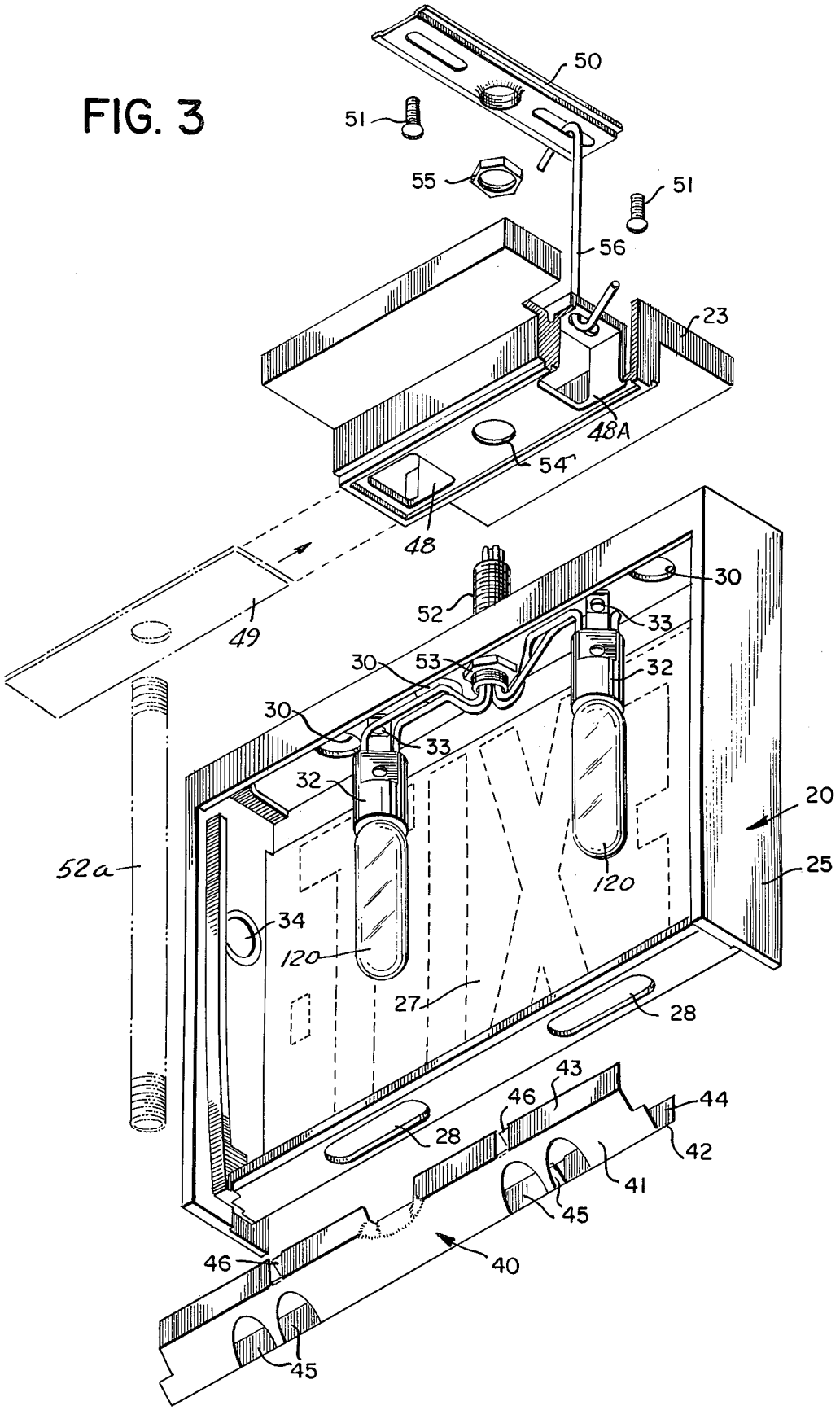
FIG. 3 is an exploded perspective view of one embodiment of the exit sign housing of this invention, depicting the mounting of the housing with a bracket to a ceiling.
Figure 4:
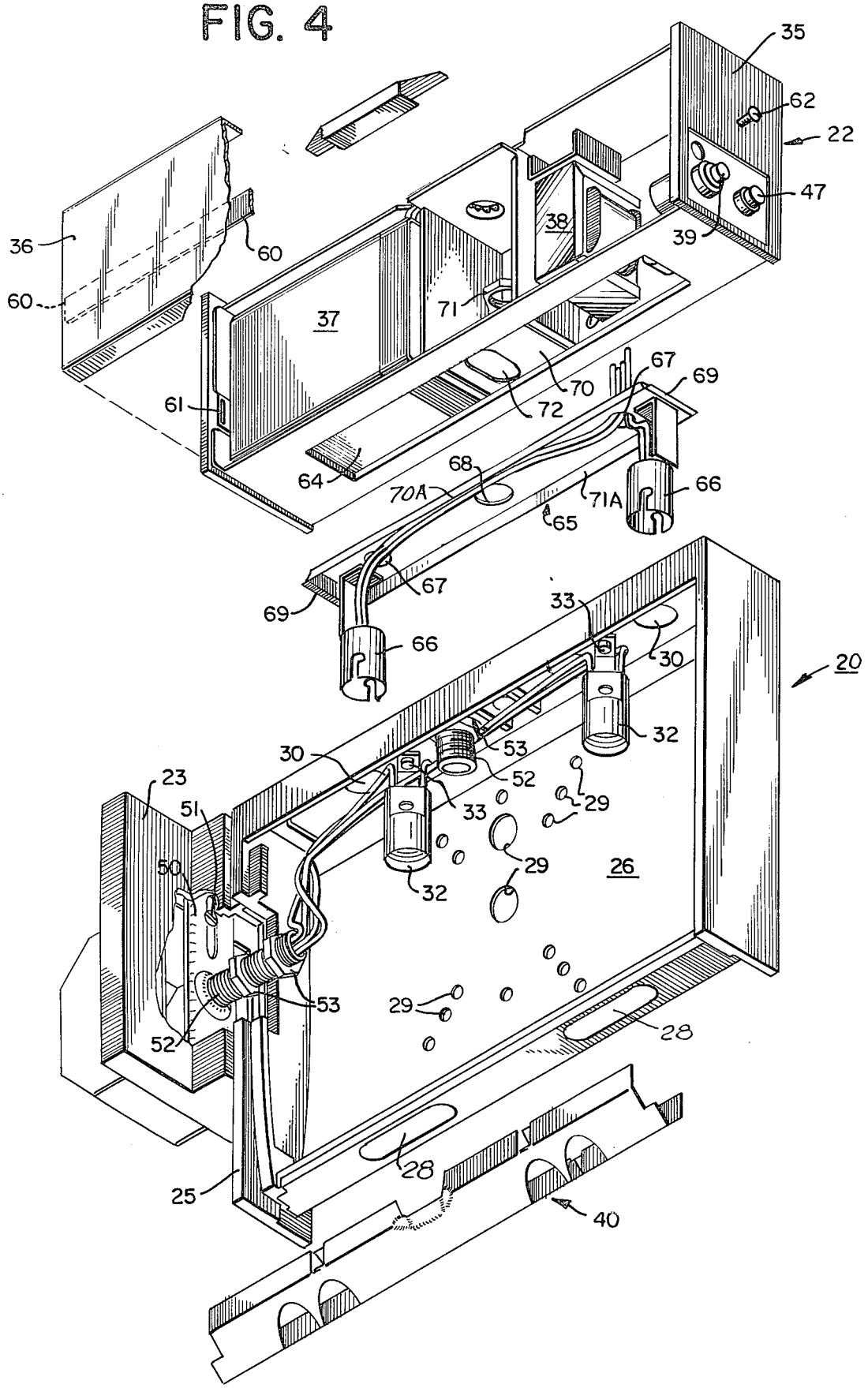
FIG. 4 is an exploded view of another embodiment of the exit sign housing of this invention, with the auxiliary power supply and bracket incorporated therein.

Exit sign housing 20 can incorporate either of two different rear panels, as shown in FIGS. 3 and 4. Generally, regardless of whether the exit sign housing is mounted to a ceiling or to a wall, the only variation is whether or not the sign housing will be flush-mounted directly against a wall. In order to provide for these two variations, the exit sign housing of this invention has two embodiments. One embodiment incorporates a rear panel 27, shown in FIG. 3, comprising a stencil of the letters "EXIT", while the other embodiment incorporates rear panel 26, shown in FIG. 4, which comprises no stencil and instead incorporates punch-out areas for any desired flush mounting arrangement.

In FIG. 3, exit sign housing 20 is shown in an exploded perspective view along with bracket 23 and the associated hardware required for mounting exit sign housing 20 and bracket 23 to a ceiling. In order to fully describe some of the features of exit sign housing 20, the removable front panel 24 is not shown. Along with front panel 24, exit sign housing 20 comprises frame structure 25 and rear panel 27. In this embodiment, rear panel 27 comprises a stencil of the letters "EXIT". As discussed above, this embodiment of the exit sign construction of this invention would be employed when both the front and rear panels of the exit sign housing 20 would be visible.

Rear panel 27 also incorporates four knock-out plugs 30 along its top surface, which serve as access holes into housing 20 for auxiliary-powered light bulb sockets. Four knock-out plugs 30 are provided, in order to allow panel 27 to cooperate with any type of emergency lighting arrangement. Panel 27 also incorporates two pre-drilled holes 33, through which normal powered light bulb sockets 32 are secured, and two knock-out plugs 28 along its bottom surface, which can be employed if downlighting is desired. As shown in FIGS. 1 and 2, similar knock-out plugs or segments 28 are also incorporated on front panel 24 to provide the downlighting when desired. Frame structure 25 incorporates side knock-out plug 34 in order to accommodate end mounting.

In the preferred embodiment, exit sign housing 20 also incorporates a removable reflector plate 40. Reflector plate 40 comprises sheet metal which has been formed to incorporate substantially V-shaped surfaces 41 and 42 with upstanding, substantially parallel flanges 43 and 44. V-shaped surfaces 41 and 42 incorporate four holes 45, which cooperate and are coaxial with knock-out plugs 30 of rear panel 27 when reflector plate 40 is installed in its proper position. Flanges 43 and 44 incorporate four tabular detents 46, which hold reflector plate 40 in position by snapping onto sockets 32.

In order to install reflector plate 40, reflector plate 40 is positioned along the inside top surface of exit sign housing 20 with light bulb sockets 32 extending through two of the four holes 45. When pushed into its retaining position, tabs 46 securely lock on sockets 32, holding reflector plate 40 in the desired position. In operation, when light bulbs 120 are installed and operating, reflector plate 40 by means of V-shaped surfaces 41 and 42 provides angular reflection of the light rays, assuring redirection of most of the rays onto the front and rear panels of exit sign housing 20. In FIG. 14, this reflection is schematically represented. This assures maximum illumination of the exit sign's stencil letters.

Furthermore, light bulbs 120 are placed in juxtaposed spaced relationship to the solid areas between the stenciled letters. Preferably, bulbs 120 are located between the E and the X, and between the I and the T. In this way, uniformity of illumination is provided.

The general method for mounting the exit sign construction of this invention to pre-existing ceiling hardware is shown in FIG. 3, along with the installation of bracket 23. First, mounting plate 50 is secured to the existing ceiling housing, not shown, by means of screws 51. Next, nipple connector 52 is secured to exit sign housing 20, using nuts 53 on the inside top surface of exit housing 20. Bracket 23 is then secured to exit sign housing 20, by passing nipple connector 52 through the cooperating hole 54 of bracket 23, and secured in position by nut 55.

The remaining assembly steps are then best performed using hanger 56, which is secured through mounting plate 50 in bracket 23, in order to suspend the partially mounted exit sign construction without the use of the installer's hands. In this way, the exit sign wires are then passed upward through the nipple connector 52 and secured to power wires in the overlying junction box to connect the normal power line to illuminate exit sign housing 20. After the connections are made, the nipple connector 52 is threadedly engaged in mounting plate 50, and the entire exit sign construction of this invention is secured in place ready for operation.

Under certain conditions, such as a high ceiling, elongated nipple connector 52A may be used in place of nipple connector 52. When elongated nipple connector 52A is employed, cover plate 49 may be used to hide holes 48 and 48A in bracket 23 which are produced during the bracket's manufacturing process.

In FIG. 4, another embodiment of the exit sign construction of this invention is shown, depicting the mounting of exit sign housing 20 to a wall, with the auxiliary power supply 22 mounted to the top of housing 20. In order to best understand the mounting procedures, exit sign housing 20 and auxiliary power supply 22 are shown in an exploded perspective view, with the removable front panel 24 not shown. Along with front panel 24, exit sign housing 20 comprises frame structure 25, rear panel 26, and reflector plate 40. In this embodiment, rear panel 26 incorporates a plurality of knock-out plugs 29 arranged in a predetermined pattern. Knock-out plugs 29 are provided in order to quickly and easily provide holes which will facilitate flush mounting of housing 21 in any desired arrangement. As discussed above, rear panel 26 will be incorporated on housing 20 for a mounting location where the rear panel of housing 20 would not be visible, and therefore would not have to incorporate the "EXIT" -lettered stencil on its surface.

Rear panel 26 also incorporates two knock-out plugs 28 along its bottom surface, which can be employed if down-lighting is desired. Furthermore, rear panel 26 incorporates four knock-out plugs 30 along its top surface, which, as described above, serve as access holes into housing 20 for any type of emergency lighting arrangement. Panel 26 is also provided with predrilled holes 33, for securement of the normal powered light bulb socket 32.

As shown in FIG. 4, exit sign housing 20 is mounted to a wall, using bracket 23. The physical mounting of exit sign housing 20 to bracket 23 and to the wall hardware, as well as the electrical connection of sockets 32 to the available wires, is made in substantially the same manner as described above, using a nipple connector 52, nuts 53, mounting plate 50, and screws 51.

Once light bulbs have been placed in sockets 32, these bulbs will fully illuminate exit sign housing 20 as long as there is no power failure. If, however, there were such a power failure, the exit sign housing 20 would not be illuminated unless connected to an auxiliary power supply.

In the exit sign construction of this invention, self-contained auxiliary power supply 22 can be mounted directly to exit sign housing 20, in order to provide emergency power thereto. If a central auxiliary power supply is available, self-contained power supply 22 would not be required.

Auxiliary power supply 22 incorporates container 35 and a removable front cover 36. Cover 36 incorporates a tongue member 60, which cooperates with receiving bracket 61 to hold the cover in place on that side of power supply 22. Cover 36 is then secured to container 35 by a screw 62.

Container 35 incorporates therein a rechargeable battery 37, an emergency power supply transformer, rectifier, transfer and battery-charging circuitry 38, a test switch 39, and an indicator lamp 47. Switch 39 is used in order to check the operability of the emergency power supply system.

Container 35 of emergency power supply 22 also incorporates an elongated opening 64, which cooperates with a socket-supporting plate 65. Two light bulb sockets 66 are rotatably mounted to plate 65 near the extremities thereof. In the preferred embodiment, the mounting point for socket 66 lies along the central axis of light bulb socket 66. In this way, the light bulb socket can be rotated without changing its position or the position of the light bulb relative to the front and rear panels of housing 20, when installed therein. This same socket construction is also used with sockets 32 of the housing itself. Plate 65 also incorporates holes 67 in order to allow the wires connected to light bulb socket 66 to be easily passed through holes 67 to the emergency power supply.

Supporting plate 65 also incorporates a hole 68 through which nipple connector 52 passes and is secured by nuts 53. In the preferred embodiment, mounting points for light bulb socket 66 on plate 65 and the center of hole 68 all lie on the same line, parallel to the sides 70A and 71A of plate 65. Furthermore, this line is not centrally located on plate 65 and instead is offset closer to side 71A of plate 65.

In order to secure supporting plate 65 to container 35 of power supply 22, supporting plate 65 is positioned in hole 64 with the outboard flanges 69 at the ends of plate 65, extending outside of hole 64. Nipple connector 52 passes through nipple plate 70 and is secured thereon by lock nut 71.

By also referring to FIGS. 16 and 17, the preferred construction of this interconnection assembly can best be understood. Plate-receiving hole or slot 64 is not centrally positioned on the bottom wall of container 35. Instead, the center point of receiving hole 64 is positioned closer to the rear of container 35, spaced a distance X therefrom. The positioning of receiving hole 64 cooperates with the position of nipple hole 68 on plate 65, in order to provide two different emergency lighting positions — one for flush mounting, and the other for wall or ceiling mounting when both the front and rear panels are visible.

As described above, nipple hole 68 and mounting points 121 for emergency lighting socket 66 are not centrally located on supporting plate 65. The center point of plate 65 and mounting point 121 for socket 66 are positioned apart a distance Y. When plate 65 is positioned in receiving hole 64, as shown in FIG. 16, the central axis of socket 66 and mounting point 121 are maintained a distance X+Y from the rear of container 35. Since the distance X+Y is substantially equal to one-half the width of container 35 when auxiliary power supply 22 is secured to exit sign housing 21, exit sign housing 20 will be substantially centrally located on the bottom surface of power supply 22, providing an attractive, symmetrical assembly when both front and rear stencil panels are displayed to view.

By pivoting supporting plate 65 180 degrees, and securing supporting plate 65 in receiving hole 64, as shown in FIG. 17, the central axis of socket 66 and mounting point 121 will be located a distance X–Y from the rear of container 35. In this position, both the rear of container 35 and the rear of sign housing will be in substantially the same plane. This orientation is particularly adapted for flush mounting of the sign housing directly against a wall. In order to facilitate the securement of plate 65 to container 35 of auxiliary power supply 22, allowing for its dual positions, nipple plate 70 incorporates an elongated receiving hole 72 for nipple connector 52 (FIG. 4).

One of the features of the exit sign housing of this invention is that the entire housing is assemblable without the use of external fastening means, such as screws, clips, etc. Each element used in the exit sign housing of this invention incorporates interlocking catches which provide a completely assembled structure quickly and easily that is completely assembled without the need for external fastening means.

By referring to FIGS. 5 through 9, the assembly of rear panel 26 to frame member 25 can best be understood. Furthermore, the assembly of rear panel 27 is identical to the assembly procedure described below, and panel 26 is used mainly for illustrative purposes.

Figures 5, 6, 7, 8, 9:
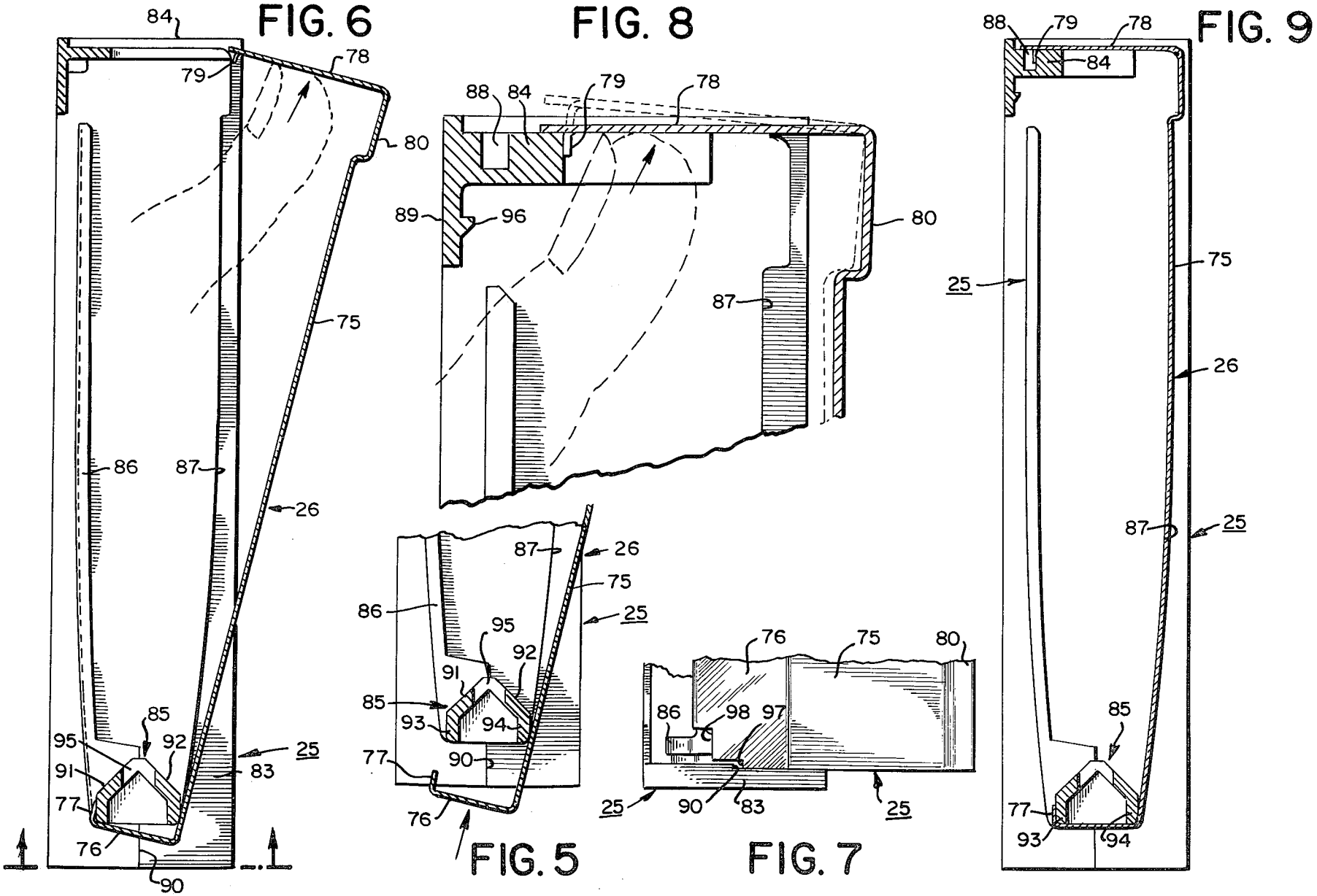
FIG. 5 is a cross-sectional partial side elevation view of the exit sign housing of this invention, showing the initial position for mounting the rear panel to the frame structure.
FIG. 6 is a cross-sectional side elevation view of the exit sign housing of this invention, showing the second position for mounting the rear panel to the frame structure.
FIG. 7 is a partial bottom view of the exit sign housing of this invention in the mounting position depicted in FIG. 6.
FIG. 8 is a cross-sectional partial side elevation showing a third position in the mounting procedure of the rear panel to the frame structure.
FIG. 9 is a cross-sectional side elevation view of the exit sign housing of this invention with the rear panel securely mounted to the frame structure.

As best seen in FIG. 6, rear panel 26 comprises a substantially flat wall portion 75, a substantially flat bottom edge 76 substantially perpendicular to wall 75, an upturned flange 77 substantially perpendicular to bottom portion 76, and a substantially flat top surface 78 substantially perpendicular to wall portion 75. Top surface 78 also incorporates downturned locking tabs 79, substantially perpendicular to top surface 78. In the preferred embodiment, wall portion 75 also incorporates a stepped portion 80. Portion 80 is included for aesthetic purposes, in order to provide a substantially similar appearance for both the front and rear of the housing.

Frame member 25 incorporates side members 83, a top portion 84, and a bottom portion 85. Each side member 83 incorporates an upstanding camming and sliding rib 86 longitudinally extending along one side thereof and a stepped portion 87 longitudinally extending along the other side thereof.

Side member 83 also incorporates a stepped portion 90 along its bottom edge surface, best seen in FIGS. 5 and 7, positioned between and substantially parallel to both rib 86 and stepped portion 87 (as shown in FIG. 5).

Top portion 84 incorporates a locking groove 88 and a depending flange portion 89, best seen in FIG. 8. Depending flange portion 89 is substantially perpendicular to top portion 84 and incorporates an upstanding camming and locking latch 96.

As best seen in FIGS. 5, 6 and 7, bottom portion 85 of frame member 25 incorporates substantially V-shaped side walls 91 and 92, which cooperate and are blended with substantially parallel side flanges 93 and 94. The V-shaped side walls 91 and 92 provide redirection of the light rays along the bottom of the sign housing in order to maximize the illumination of the panels when installed. This light ray redirection is shown schematically in FIG. 14. Also, bottom portion 85 incorporates holes 95 in order to provide downlighting when desired.

The first step in mounting rear panel 26 to frame member 25 is shown in FIG. 5. Wall portion 75 of rear panel 26 is slidingly advanced along flange 94 of bottom surface 85 until bottom surface 76 of panel 26 abuts flange 93 with upstanding flange 77 of panel 26 engaged on flange 93 of bottom portion 85, as shown in FIG. 6. When this position is reached, the edge of top surface 78 of panel 26 will abut against top surface 84 of frame member 25. Also, as shown in FIG. 7, step portion 97 of bottom surface 76 of panel 26 is held in parallel juxtaposition to step portion 90 of side member 83 of frame member 25.

The next step in the installation process of rear panel 26 on frame member 25 can best be understood by referring to FIG. 6. Top surface 78 of rear panel 26 is pushed upwardly, using the thumbs of the installer, thereby causing top surface 78 to be raised above top surface 84 of frame member 25. Simultaneously, rear panel 26 is advanced towards frame member 25 until the position shown in FIG. 8 is obtained. In this position, rear panel 26 is almost completely installed; however, locking tab 79 abuts an inside surface of top portion 84 of frame member 25. The final installation is obtained by again pushing top surface 78 of rear panel 26 with the thumbs of the operator, as shown in FIG. 8, moving top surface 78 to the position shown in phantom, and then moving rear panel 26 until depending locking tab 79 is secured within receiving hole 88 of top surface 84. The final installed position is shown in FIG. 9.

In the final secured position, wall portion 75 abuts against raised portion 87 of frame member 25, causing wall portion 75 to cammingly bend along the curved portion of raised surface 87. Since bottom surface 76 and flange 77 of rear panel 26 are secured about flanges 93 and 94 of bottom portion 85 of frame member 25 and the normally planar wall portion 75 of panel 26 is forced to convexly bend along raised portion 87 of frame member 25, locking tab 79 of panel 26 is firmly held against the side wall of receiving hole 88, securely maintained in position by the biasing forces produced by wall portion 75 being locked in the convex orientation.

With rear panel 26 securely locked in position on frame member 25, front panel 24 can now be installed on frame member 25. This installation can best be understood by referring to FIGS. 10 and 11.

Front panel 24 incorporates a substantially flat side portion 101, and a substantially flat bottom portion 102 perpendicularly disposed to side portion 101. Side portion 101 comprises a stencil of the letters "EXIT", and a removable direction arrow 120 on both sides of the "EXIT" stencil. Removable arrow 120 is included in order to allow the precise location of the exit to be clearly indicated. Removable arrow 120 incorporates "half-staked" portions 122 and punched, sheared portion 124 forming the remainder of the arrow 120. The major portion of arrow 120 is punched and sheared, and then forced back into place, forming portion 124. The short portions 122 are "half-staked" or scored, serving to hold removable arrow 120 in place, while still allowing its quick and easy removability when desired.

Figures 10, 11:
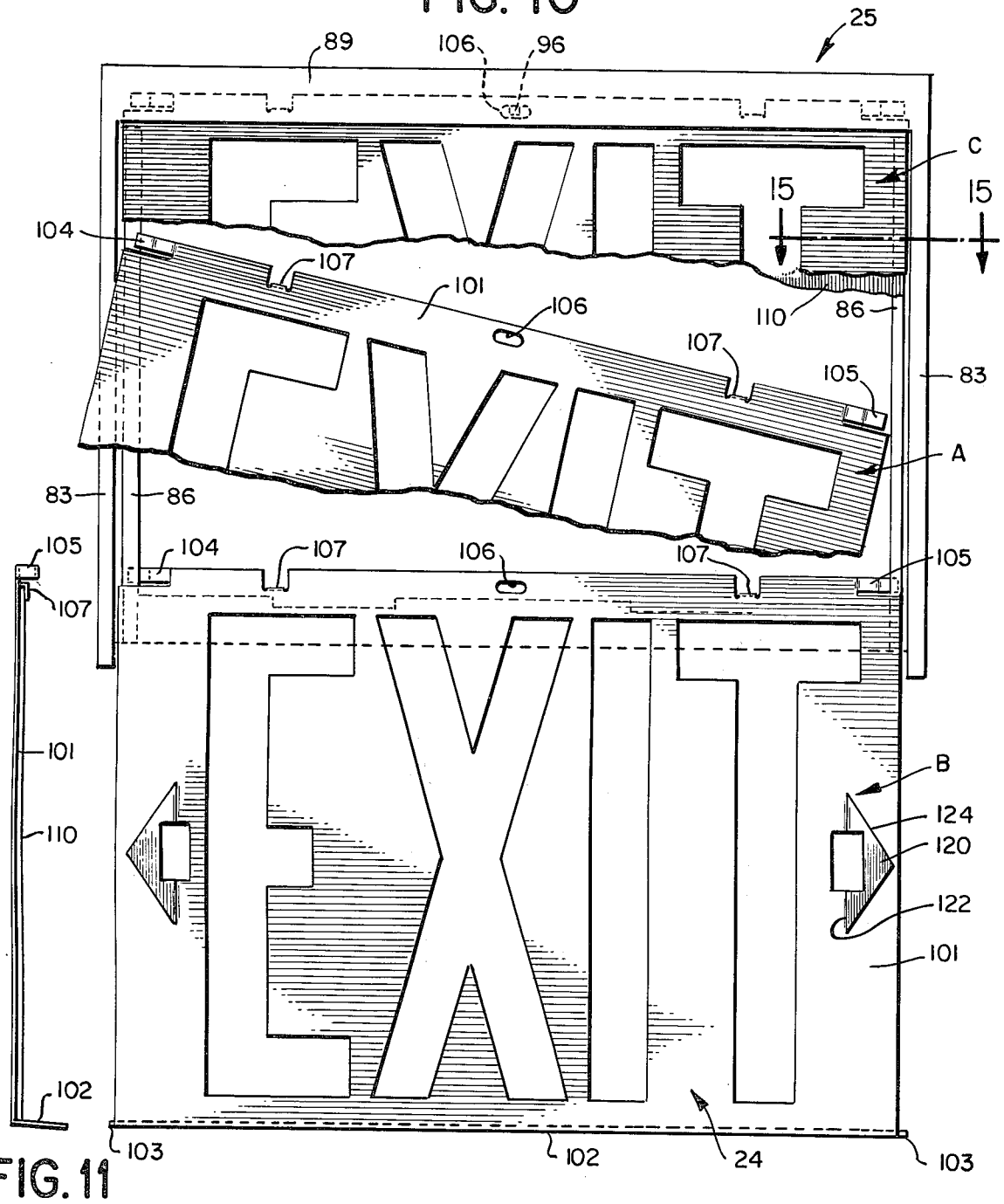
FIG. 10 is a front elevation view of the exit sign housing of this invention showing the installation of the front panel to the frame structure.
FIG. 11 is an end view of the front panel of the exit sign housing of this invention.

Front panel 24 also incorporates a stepped portion 103 at both ends of bottom surface 102 and holding tabs 104 and 105 at both ends of the top surface of side 101. As shown in FIG. 11, both tabs 104 and 105 are bent and offset in order to provide a tab surface which is substantially offset and parallel to side portion 101. Furthermore, panel 24 incorporates along its top surface a latch-engaging hole 106 and two bent clips 107 for securely holding a diffuser plate 110 in place.

Panel 24 is constructed in order to provide for its easy installation, while also allowing panel 24 to have both a securely locked position and also a trapped open position which allows easy access to the light bulb sockets for installing and changing bulbs. This two-fold construction is achieved by having tabs 104 and 105 of panel 24 slideably engaged with upstanding ribs 86 of frame member 25 on both sides of frame member 25.

In order to install panel 24 on frame member 25, the panel is diagonally positioned across frame member 25, as shown in position "A" of FIG. 10. Upstanding rib 86 on the left-hand side of frame member 25 is captured between tab 104 and side portion 101 of panel 24, while rib 86 on the right-hand side of frame member 25 is captured between tab 105 and side portion 101 of front panel 24. Then, panel 24 is positioned so that the top edge of side portion 101 is substantially parallel with the top edge of frame member 25, as shown in position "B" of FIG. 10. In this position, panel 24 is freely slideable along ribs 86 of frame member 25.

Panel 24 now has substantially two positions. One position is completely open wherein panel 24 freely hangs from frame member 25, captured in this position by tabs 104 and 105, which are secured around the rear sides of upstanding ribs 86 of frame member 25. As shown in FIG. 6, rib 86 incorporates an enlarged area near its base which serves as a stop for holding panel 24 in the panel's open position. In this position, complete access to the light bulb socket disposed within the exit sign housing is freely attainable. This is shown by position "B" of FIG. 10.

In order to lock panel 24 in its normal latched position, as shown in position "C" of FIG. 10, panel 24 is slid upwardly along upstanding ribs 86 of frame member 25 until step portions 103 of bottom portion 102 of panel 24 is engaged with the base of sides 83 of frame member 25, as well as ramped latch 96 being engaged by hole 106 of panel 24. This sliding, latching securement of panel 24 to frame member 25 can best be understood by referring to FIGS. 12 and 13.

Figure 12:
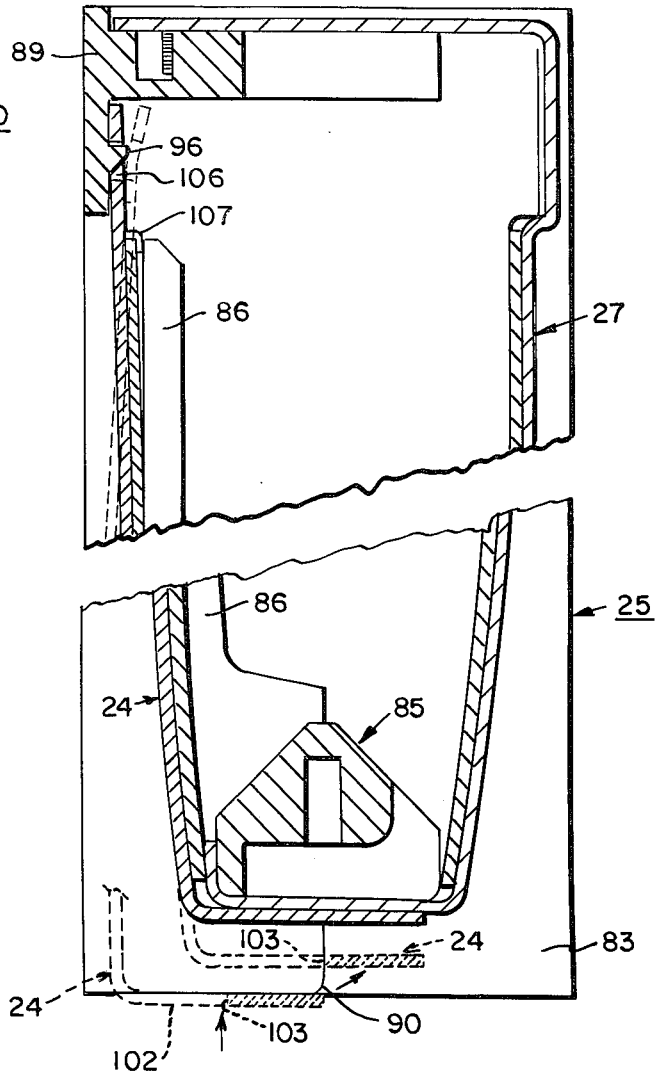
FIG. 12 is a cross-sectional partial side elevation view of one embodiment of the exit sign housing of this invention completely assembled, with the various positions required to assemble the front panel shown in phantom.
Figure 13:
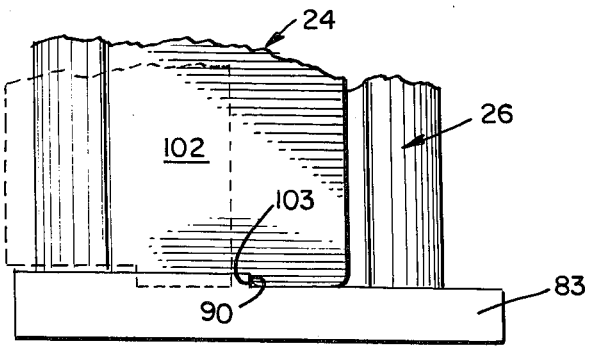
FIG. 13 is a partial bottom view of the exit sign housing of FIG. 12.

In FIG. 12, the various positions prior to complete installation of panel 24 on housing 25 are shown in phantom. As discussed above, panel 24 is slidingly engaged with ribs 86 of frame member 25 and is moved along these upstanding ribs until panel 24 is juxtaposed to the bottom edge of side 83 of frame member 25. At this point, bottom portion 102 of panel 24 is moved laterally sideways until offset portion 103 of panel 24 engages offset 90 of side 83 of frame member 25. Then, panel 24 is moved upwardly until hole 106 of side portion 101 of panel 24 deflects and then surroundingly engages camming latch 96 of frame member 25. In this position, panel 24 is securely locked on latch 96 and is biased against the inside wall of flange 89 of frame member 25 due to the forced deflection of side 101 by the curvature of upstanding rib 86.

Upstanding rib 86 of frame member 25, as best seen in FIG. 14, comprises an over-all curved shape extending the length of side member 83 of frame member 25. Since panel 24 incorporates a substantially flat side portion 101, the inwardly spaced capture and lock of base 102 of panel 24 by offset portion 90 of side 83 of frame member 25 forces panel 24 to be convexly arranged on frame member 25. This convex orientation forces top portion 106 to press tightly against flange 89 of frame member 25, thereby assuring the secure locked engagement of panel 24 on latch 96.

This biasing locked engagement of panel 24 as well as rear panel 27 is enhanced by the inclusion of a diffuser plate 110 on both panels 24 and 26. The diffuser plate is preferably a fiberglass-reinforced, translucent plastic in a color complying with local codes, most usually red, and is employed to assure the high visibility of the "EXIT" letters on the front and rear panels. In the flush mounting construction wherein rear panel 26 is used, a rear diffuser plate is not required.

Clips 107 of front panel 24 are employed to securely lock diffuser plate 110 in its proper position. The completely assembled exit sign housing of this invention with the diffuser plates employed in both the front and rear panels is shown in FIG. 14.

An additional problem which has existed in prior art exit sign constructions is the difficulty of eliminating visible illumination along the edges of the front and rear panels where they meet the frame member. In order to eliminate this undesirable lighting effect, upstanding ribs 86 of frame member 25 incorporate a channel 112 extending the entire length of ribs 86 along the side members 83 of frame member 25. Channel 112 is shown in FIG. 15.

It has been found that by incorporating channel 112 along upstanding ribs 86 of frame member 25 and installing diffuser plate 110 and panel 24 in position, this undesirable side lighting is eliminated. It is believed that channel 112 provides an area for the light rays to internally reflect off the walls of channel 112 and thereby eliminate the undesirable visible light leakage. If desired, foam material 114 can be mounted in channel 112 in order to further reduce undesirable visible light leakage.

By employing the exit sign construction of this invention, as completely disclosed above, a unique exit sign housing is provided which is completely assembled without the need for external fastening means. All of the parts are made to be interfitting and interlocking in a mating fashion, which assures a completely rigid construction firmly held together by the internal construction of the components. Furthermore, the exit sign housing is completely adaptable with a self-contained auxiliary power supply which can be quickly and easily mounted to the exit sign housing of this invention. Also, the internal construction of the exit sign housing incorporates internal reflection members, which enhances the desired reflection of light rays in order to fully illuminate the exit sign lettering.

It will thus be seen that the objects set forth above, among those made apparent from the preceding description, are efficiently attained and, since certain changes may be made in the above product without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the invention which, as a matter of language, might be said to fall therebetween.

Having described my invention, what I claim as new and desire to secure by Letters Patent is:

1. A sign housing comprising:
A. a frame member incorporating
a. a bottom portion,
b. a top portion and
c. two side portions interconnecting said top and bottom portions;
B. a rear panel removably mounted to said frame member and engageable with said top and bottom portions of said frame member; and
C. a flexible front panel
a. removably mounted to said frame member,
b. vertically slidingly engaged with said frame member along a substantial portion of the side portions thereof in substantially the same vertical plane from a first latched position to a second opened, retained position with said front panel vertically extending below said bottom portion and
c. dimensioned for flexible latched cooperation with said frame member to secure said front panel in said first latched position,
whereby access to the interior of the sign housing can be made while said front panel is retainingly suspended in its second position, vertically below the sign housing.

2. The sign housing defined in claim 1, wherein said front panel comprises a stencil of the letters "EXIT", and wherein said sign housing incorporates internal lamp means positioned between the panels in juxtaposed spaced relationship to solid areas between the letters.

3. The sign housing defined in claim 2, wherein said sign housing also incorporates a diffusion plate position directly behind said stenciled front panel for increasing the visibility and readability of the stenciled letters.

4. The sign housing defined in claim 2, wherein said rear panel comprises a stencil of the letters "EXIT".

5. The sign housing defined in claim 1, wherein said frame member includes an upstanding rib portion longitudinally extending along each of said side portions and cooperating with said front panel as a track along which the front panel is slidably engaged, thereby providing quick access into said sign housing by moving said front panel from its normally closed latched position to an open unlatched position.

6. The sign housing defined in claim 1, wherein said sign housing includes removable knock-out segments on the top surface and the side portion thereof, providing universal mounting capability for said sign housing.

7. The sign housing defined in claim 1, wherein said rear panel incorporates light bulb sockets for interconnection with a power supply and secured to an upper surface thereof which is engageable with the top portion of said frame member.

8. The sign housing defined in claim 7, wherein said light bulb sockets are mounted to the rear panel at a point which lies substantially along the central axis of the light bulb sockets, thereby allowing rotation of the sockets without movement of any light bulb mounted therein towards either the front or rear panel.

9. The sign housing defined in claim 7, wherein said sign housing further comprises a light deflector plate mountable to said light bulb sockets and incorporating two intersecting surfaces angularly disposed for reflection of light rays towards the front and rear panels.

10. The sign housing defined in claim 9, wherein said bottom portion of said frame member incorporates two intersecting surfaces angularly disposed for deflection of light rays towards the front and rear panels.

11. A sign housing comprising:
A. a frame member incorporating
a. a bottom portion,
b. a top portion incorporating
1. tab receiving recesses, and
2. front panel latch means, and
c. two side portions interconnecting said top and bottom portions and incorporating on its inside surface;
1. a longitudinally extending upstanding rib spaced inwardly of one edge of said side portion,
2. a first step portion spaced inwardly from the outer edge of said side portion and longitudinally extending along a major portion of said side portion, and
3. second step portion positioned between said rib and said first step portion extending substantially parallel to the edges of said side portion, near said bottom portion, providing seated positioning for said installed front and rear panels;
B. a rear panel removably mounted to said frame member engageable with said top and bottom portions of said frame member; and
C. a flexible front panel removably mounted and slidingly engaged with said frame member along said upstanding rib and dimensioned for flexible latching cooperation with said frame member to secure said front panel in an installed and latched position.

12. The sign housing defined in claim 11, wherein said rear panel comprises:
a. a substantially flat side surface,
b. a bottom surface substantially normal to said side surface and incorporating an upturned flange extending along the edge thereof, and
c. a top surface substantially normal to said side surface and incorporating down-turned tabs,
whereby upon mounting said rear panel on said frame member, said bottom surface and upturned flange of said rear panel peripherally surround and capture the bottom portion of the frame member, the side surface of the rear panel retainingly conforms to the longitudinal shape of the first step portion of the side member of the frame member, and side downturned tabs of said top surface of said rear panel lockingly engage said recesses of said top portion of said frame member.

13. The sign housing defined in claim 12, wherein said first step portion of said frame side portion comprises a convex shape along a portion thereof, thereby causing the side surface of said rear panel to bend concavely in conformance therewith and said downturned tabs of said top surface of said rear panel to be firmly secured in flexible latching engagement within the recesses of the top portion of said frame member.

14. The sign housing defined in claim 12, wherein said sign housing incorporates internal lamp means, said frame bottom portion incorporates at least one slot forming an open area vertically through said bottom portion, and said bottom surface of said rear panel incorporates at least one removable knock-out segment in juxtaposed spaced relationship to said bottom portion slot for providing down lighting.

15. The sign housing defined in claim 11, wherein said upstanding ribs incorporate stop means at the bottom end thereof and said front panel comprises:

a. a substantially flat side surface incorporating rib capture means at the top corners thereof, and b. a bottom surface substantially normal to said side surface and incorporating offset portions along the side edges thereof, adapted for cooperative engagement with said second step portion of said frame side portion, whereby said front panel is slidably engaged along said ribs from a securely retained open position to a latched position with said offset positions engaged with said second step portions of said frame side portion.

16. The sign housing defined in claim 15, wherein a portion of said upstanding rib comprises a convex shape, whereby said front panel conforms to the curvature of said upstanding ribs upon engagement of the offset portion of the front panel's bottom surface by the second step portion of the frame side portion, thereby causing said front panel to biasingly and firmly engage said latch means of the top portion of the frame member.

17. The sign housing defined in claim 15, wherein the width of said front panel is greater than the distance between said upstanding ribs, and each rib capture means comprises a tab 1. offset from the plane of the side surface of the front panel,
2. a portion of which is parallel to the plane of the side surface of the front panel, whereby each upstanding rib is captured between one said offset tab and a portion of said side surface of the front panel.

18. The sign housing defined in claim 17, wherein each of said rib capture means is initially engaged about its respective upstanding ribs by positioning the top edge of said front panel in an angularly skewed relationship with said upstanding ribs, whereby upon movement of said front panel to its normal position with its top edge substantially perpendicular to said upstanding ribs, said front panel is securely slideably engaged to said frame member.

19. The sign housing defined in claim 17, wherein said sign housing incorporates internal lamp means and each of said upstanding ribs incorporates an outwardly facing groove longitudinally extending substantially the entire length of said ribs, for entrapping unwanted visible light reflections when said front panel is installed in its latched position.

20. The sign housing defined in claim 19, wherein said groove incorporates a strip of foam material cooperating with said front panel to substantially seal the light within the sign housing when said front panel is installed in its latched position.

21. A self-illuminating sign assembly incorporating

A. a power supply unit comprising a. a container incorporating 1. a self-contained emergency power supply system having a rechargeable storage battery, a battery charger and transfer circuitry,
2. light bulb sockets connected to said power supply system,
3. a multi-position interconnection assembly for mounting said power supply assembly to a sign housing in a plurality of orientations; and B. a sign housing comprising a. a frame member incorporating 1. a bottom portion,
2. a top portion, and
3. two side portions interconnecting said top and bottom portions, b. a rear panel removably mounted to said frame member, engageable with top and bottom portions of said frame member, forming the exposed top portion of said sign housing and incorporating removable knockout segments for insertion of said light bulb sockets of said power supply assembly therethrough, and c. a front panel removably mounted and vertically slidingly engaged with said frame member, adapted for latching cooperation with said frame member to secure said front panel in a normally closed position while also providing for an open position with said front panel vertically extending below the bottom portion of said frame member, thereby providing complete access to said light bulb sockets.

22. The sign assembly defined in claim 21, wherein said interconnection assembly comprises a plate aa. incorporating the light bulb sockets thereon, and bb. securable to the container of said power supply assembly in two orientations having different positions for the light bulb sockets.

23. A sign assembly comprising

A. a power supply unit comprising a. a container incorporating 1. a self-contained emergency power supply system having a rechargeable storage battery, a battery charger and transfer circuitry,
2. light bulb sockets connected to said power supply system,
3. a multi-position interconnection assembly for mounting said power supply assembly to a sign housing in a plurality of orientations, including a plate aa. incorporating the light bulb sockets thereon, and bb. securable to the container of said power supply assembly in two orientations having different positions for the light bulb sockets, 4. a substantially rectangular shape, and
5. a cut-out portion for interconnected assembly with said plate, extending along the base of the container and having a center point a distance X from the rear of the container, and said light bulb sockets are mounted on said plate along a line offset from the centerline of said plate by a distance Y, whereby said plate is securable to said container with said light bulb sockets positioned a distance either (X−Y) or (X+Y) from the rear of the container, B. a sign housing comprising a. a frame member incorporating 1. a bottom portion,
2. a top portion, and
3. two side portions interconnecting said top and bottom portions, b. a rear panel removably mounted to said frame member, engageable with top and bottom portions of said frame member, forming the exposed top portion of said sign housing and incorporating removable knockout segments for insertion of said light bulb sockets of said power supply assembly therethrough, and c. a front panel removably mounted and vertically slidingly engaged with said frame member, adapted for latching cooperation with said frame member to secure said front panel in a normally closed position while also providing for an open position with said front panel vertically extending below the bottom portion of said frame member, thereby providing complete access to said light bulb sockets, whereby said power supply unit is interconnectible with said sign housing in both a first position with the rear surfaces of the power supply unit and the sign housing substantially planar and in a second position with the sign housing substantially centered on the centerline of the power supply unit.

* * * * *